US005740713A

United States Patent [19]

Korb

[11] Patent Number: 5,740,713

[45] **Date of Patent: *Apr. 21, 1998**

[54] NOTCH CUTTER

[76] Inventor: Lothar Korb, 22 Burningham Cr., Ajax, Ontario, Canada, L1S 6A2

[ * ] Notice: The term of this patent shall not extend beyond the expiration date of Pat. No. 5,463,920.

[21] Appl. No.: 526,552

[22] Filed: Sep. 12, 1995

Related U.S. Application Data

[63] Continuation-in-part of Ser. No. 172,173, Dec. 23, 1993, Pat. No. 5,463,920.

[51] Int. Cl.[6] ..... B26D 1/09; B26D 3/14

[52] U.S. Cl. ..... 83/582; 83/636; 83/693; 83/917; 83/937

[58] Field of Search ..... 83/56, 620, 635, 83/636, 639.1, 646, 692, 693, 699.31, 699.51, 917, 936, 937, 582; 144/216, 217

[56] References Cited

U.S. PATENT DOCUMENTS

| | | | |
|---|---|---|---|
| 422,517 | 3/1890 | Fox | 144/217 X |
| 1,139,572 | 5/1915 | Perry | 83/912 X |
| 3,213,741 | 10/1965 | Harding | 83/693 X |
| 3,215,017 | 11/1965 | Rutz | 83/693 X |
| 3,277,763 | 10/1966 | Haug | 83/693 X |
| 3,620,114 | 11/1971 | Chudyk | 83/693 X |
| 4,124,937 | 11/1978 | Gaughf, Jr. | 83/693 X |
| 4,129,054 | 12/1978 | Fazis | 83/693 X |
| 4,481,848 | 11/1984 | Ikeda | 83/692 X |
| 4,483,227 | 11/1984 | Camisa | 83/693 X |
| 4,558,619 | 12/1985 | Caumont | 83/699.31 X |
| 4,831,910 | 5/1989 | Poulsen | 83/693 |
| 4,930,384 | 6/1990 | Nakatsuji | 83/692 X |
| 5,035,163 | 7/1991 | Bakermans | 83/917 X |
| 5,295,424 | 3/1994 | Aulicky | 83/693 X |
| 5,463,920 | 11/1995 | Korb | 83/636 X |

*Primary Examiner*—Clark F. Dexter

[57] ABSTRACT

A notch cutter provides a first pair of inwardly facing shear edges in a V. A second pair of outwardly facing shear edges make an almost complementary V with a slightly smaller convergence angle. One pair of shear edges is caused to contact respective ones of the other pair along contact points moving from the entrance of the notch to the apex of the notch. One pair of shear edges is resiliently mounted relative to the other. When used to separate strips and form the ends of the separated strips, the V's of the first and second edge pairs may be truncated since the shear edges need only be wider than the strips on which they act to form their separating and edge shaping functions.

11 Claims, 8 Drawing Sheets

NOTCH CUTTER

This application is a continuation-in-part of application Ser. No. 08/172,173 filed Dec. 23, 1993, now U.S. Pat. No. 5,463,920.

This invention relates to a cutter for cutting tapering notches in the edge of a fabric.

Notches can be required in a fabric edge for many reasons, such as for folding the outer strips of mattress covers at the corners, for producing gussets or pleats or for many other purposes. Also as the application later shows, a notch may be made in one fold of a doubled fabric to produce an aperture in the fabric.

SUMMARY OF THE INVENTION

The notches cut by the apparatus of this invention are those which commence at two spaced points or "start locations" at the edge of the fabric (or a fold acting as an edge) and continuously converge to an apex at a point inward on the fabric from the edge.

Although in the preferred embodiment, the notch has two straight edges converging at 90° to each other, other convergence angles may be used, the notch need not be symmetrical and the edges of the notch need not be straight.

In accordance with the invention a first, usually stationary member, provides a pair of inwardly facing shear edges defining the notch and continuously converging from two spaced start locations corresponding to the mouth, i.e. entrance of the notch, to a point forming the apex of the notch.

A line is defined for the location of the fabric edge (or fold acting as an edge) and includes said spaced start locations.

A second pair of shear edges is provided. The second pair of edges is mounted to move relative to the first pair in a cutting direction to perform the cutting action. The second pair of edges is outwardly facing and, when viewed in the cutting direction, converge to an apex as do the first pair of edges; but the second pair of edges have a slightly smaller angle of convergence. Thus where, in the preferred embodiment, the angle of convergence viewed in the cutting direction is 90° for the first pair of shear edges, the angle of convergence for the second pair of edges is 89° 30' so viewed.

One or both of the pairs of edges is resiliently mounted as hereinafter described.

The first and second pair of shear edges are so mounted relative to each other, that with a fabric edge lying along the line of the two spaced start locations and with the body of the fabric overlying the first edges apex, these second shear edges may be located or advanced to make point contact with the respective first shear edges at the two spaced start locations. At this point the second edge apex will be further from the contact points than the first shear edges. What is referred to as a 'point contact' herein is realistically a very short line contact. An actual point contact would be a practical impossibility and, could it he achieved, would cause contacting shear edges to gouge each other. As the line increases in length, pressure between the contacting shear edges decreases until it is insufficient to cut the fabric. Thus the 'point contact' herein is a very short line contact. As movement in the cutting direction is continued the contact points move gradually toward the first shear edge apex until the apex is reached at which time the first and second shear edge apices coincide. The relative movement of the second edges is permitted which allows relative movement of one of the sets of shear edges, the resilient mounting of one of the sets of edges in a direction tending to bring the apices into coincidence. As the second shear edges are progressively moved relative to the first in the advance direction, the fabric is progressively cut at the point contact from the two start locations toward the apices, the point contact being maintained between the interacting shear edges as they move toward the apices. This point contact tends to create a clean cut of every fibre in the fabric.

The resilient relationship of the first and second shear edges has two main functions. Firstly, it allows, during movement of the edge pair in the cutting direction, sufficient deflection to allow relative retraction of the second pair of shear edges, on the movement of the contact points from the start locations to the apices which will coincide on the arrival of the contact points. Secondly, the resilient relationship allows limited relative tilting between the edge set to compensate for minor misalignmant of the edge set geometry. The preferred resilient mounting comprises a pair of compression springs which bias the second edge pair toward the apex. During the cutting operation the springs are adapted to provide enough pressure at the contact point to cut the fabric and the spring pressure tends to maintain the sharpness of the contacting shear edges due to a slight abrasion of the contacting edges during each stroke.

Preferably the resilient mounting for one pair of (preferably the second) shear edges comprises a direct mounting member. The mounting member is preferably biased by compression springs toward the apex at a location laterally displaced from the first shear edges when viewed in the line joining the start positions. It is noted that the movement permitted by these compression springs must be sufficient to accommodate the lateral movement of the second pair of shear edges during the cutting stroke. At a location displaced from the first shear edges in the cutting direction the mounting member is biased by a compression spring relative to the support member in a direction away from the apex.

The combination of the resilient biasing toward the apex and the displaced biasing away causes the mounting member to act somewhat like a member pivoted at the displaced location to move about on an axis roughly parallel to the line joining the start locations. It further imparts a slight angle to the defining side of the second shear edges assisting in creating point contact with the first shear edges. The biasing means preferably allow slight movement in directions lateral with respect to their biasing direction. They also allow slight tilting of the mount about axes with components in the cutting direction. This allows the resiliently mounted knife a small leeway for self adjustment in the event the two pairs of edge members are misaligned and tends to provide equal pressure at the contact points.

However, the means for relative movement between the first and second edge sets may be distributed between them in any desired manner. Thus, in the preferred embodiment the second set of shear edges is mounted to (a) resiliently move to bring the apices toward alignment as the contact points progress theretowards (b) resiliently move laterally (c) resiliently tilt about axes having components in the cutting direction.

However, in relation to any one or more of (a), (b) or (c) the second set of shear edges may be fixed and the first set resiliently mounted to allow the relative movement or tilting to produce the corresponding type of relative movement between the two sets of shear edges.

In accordance with another aspect of the invention, the tool used for producing the notches, may be used to separate strips of fabric and to shape their ends. In such use, the fabric will not be of sufficient width to reach either apex of a shear edge pair. Thus for such use, the shear edge pairs, as already described, may be used even though the cut through the narrower strip will not extend to coincident apices. Thus if cutting narrower strips is the only purpose of a given apparatus, the shear edge pairs need only be long enough to perform the cutting action across the width of the strip and need not be continued to an apex—but only for a sufficient distance to sever the strip and shape its ends. In this variant, although the cooperating shear edges do not continue to respective apices, they are shaped as if they did.

Thus, the edge pairs may each be considered as converging toward an apex, even though the apex is not physically present.

BRIEF DESCRIPTION OF THE DRAWINGS

In drawings which illustrate an embodiment of the invention.

DETAILED DESCRIPTION OF THE PREFERRED EMBODIMENT

Figure 2A:
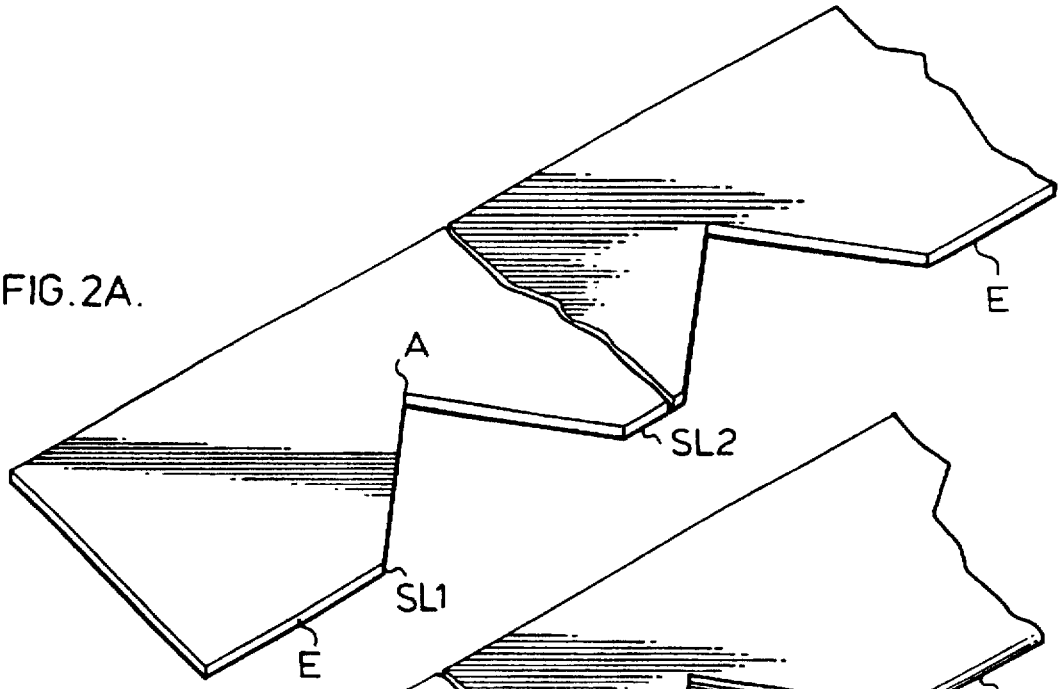
FIG. 2A, 2B and 2C demonstrate the appearance of two exemplary forms of fabric notch.

In the drawings, FIG. 2A shows a notched fabric where the notch edges continuously converge at 90° from spaced start locations SL1, SL2 at the fabric edge to apex A inwardly of the edge.

Figure 2B:
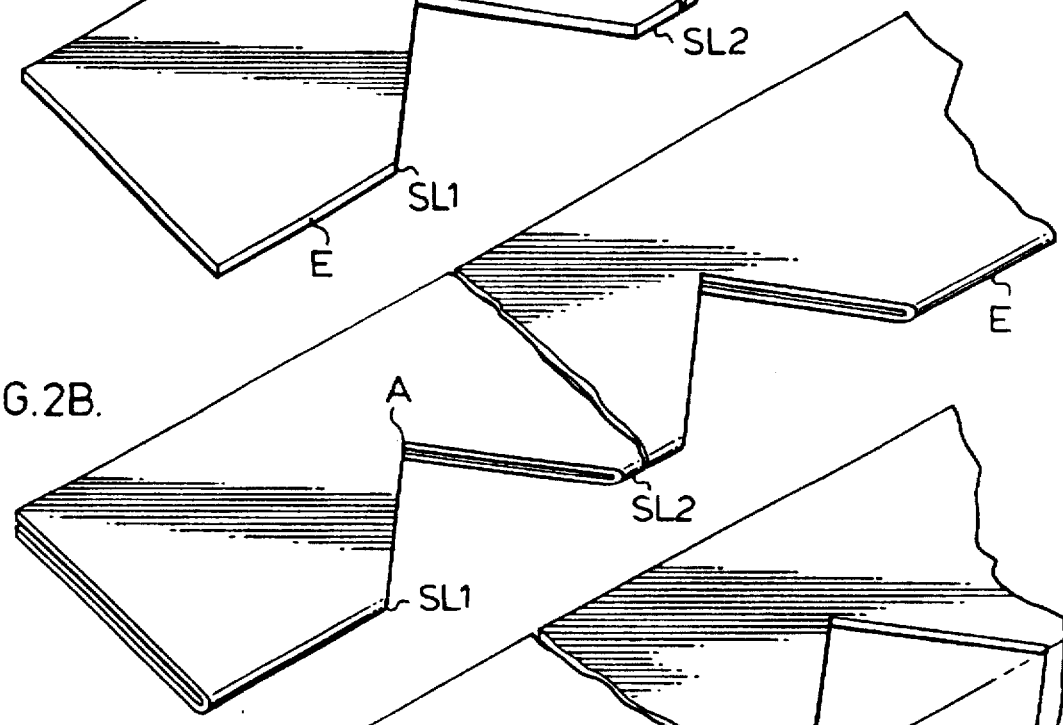
Figure 2C:
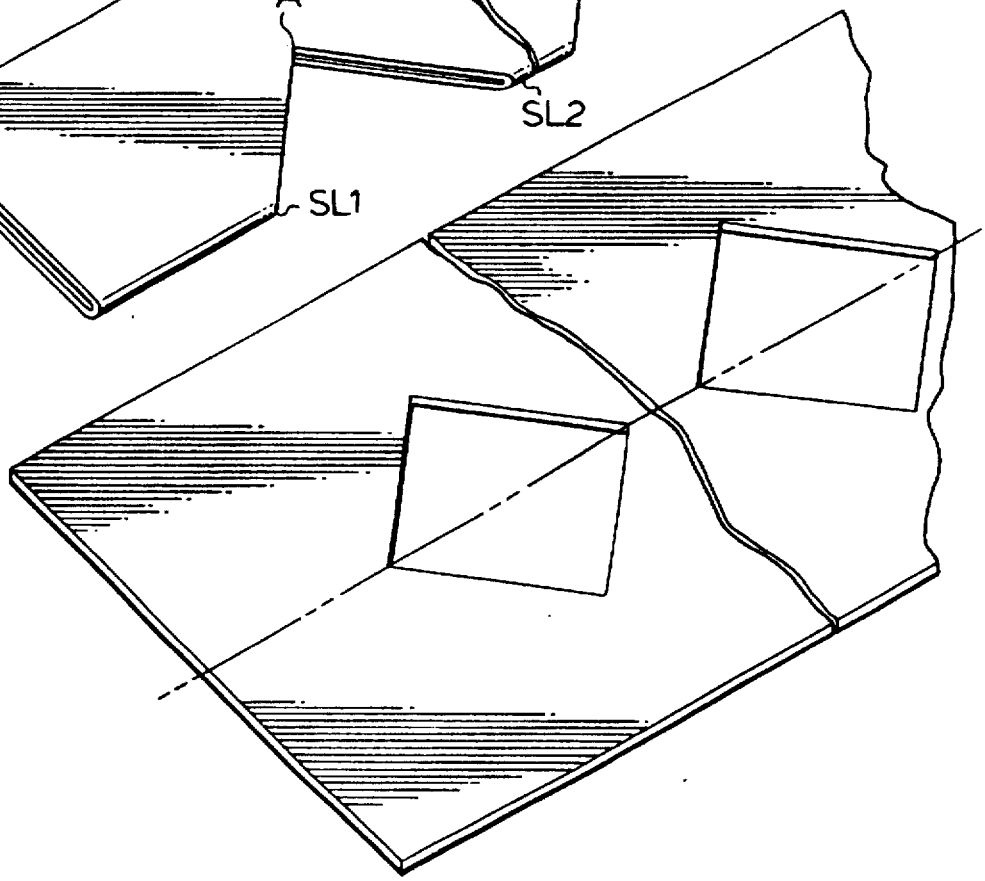

FIG. 2B shows a folded fabric notched at the fold line to produce square apertures (FIG. 2C) when the fabric is unfolded.

The fabric, which is notched along an edge, may be several feet or yards wide.

Figure 1:
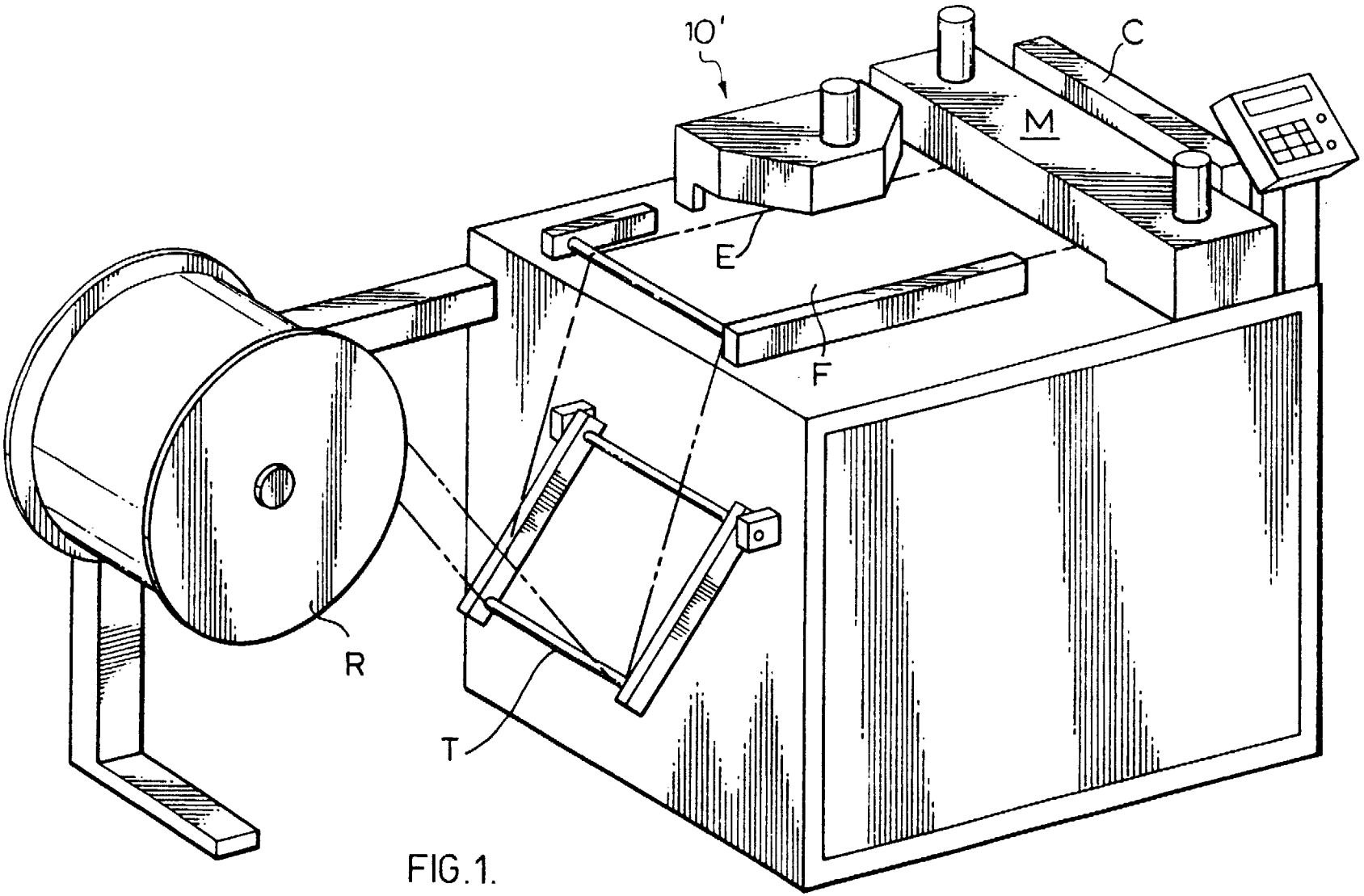
FIG. 1 is a perspective view showing the environment for the fabric and the fabric cutter.

FIG. 1 is a schematic view showing the path, in chain dots, of a typical fabric F path from a supply roll R across a table by a measuring machine M to a guillotine cutter, C, where edge E will be notched by the apparatus 10' to be described in detail. Except for the apparatus 10' the equipment shown is conventional. Thus the supply roller and take up bar T will have biasing and tensioning (not shown) located in the measuring machine which together will maintain the fabric stationary and positioned during the notch cutting operation. Other conventional means for so maintaining the fabric position may of course be used.

FIGS. 3 to 10 demonstrate schematically the working of the invention. A first knife mounted on support 11 comprises the body 10 defining inwardly facing shear edges 12 and 14 open to one edge of the body and continuously converging from spaced start locations SL1 and SL2 to an apex A. Thus the line SL1–SL2 defines the entrance to the notch. As demonstrated by FIG. 10 the knife edge 14 is defined by surface 14B, perpendicular to direction K and surface 14A at an angle of two degrees (2° ) to direction K. Knife edge 12 is similar. A second knife is carried by a moving support to advance in a cutting direction K to perform the notching action. The second knife comprises the edges 16, 18. As demonstrated by FIG. 10 the knife edge 18 is defined by surface 18A, parallel to direction K and surface 18B at an angle 120° to direction K. The knife edge 16 is similar.

Figure 6:
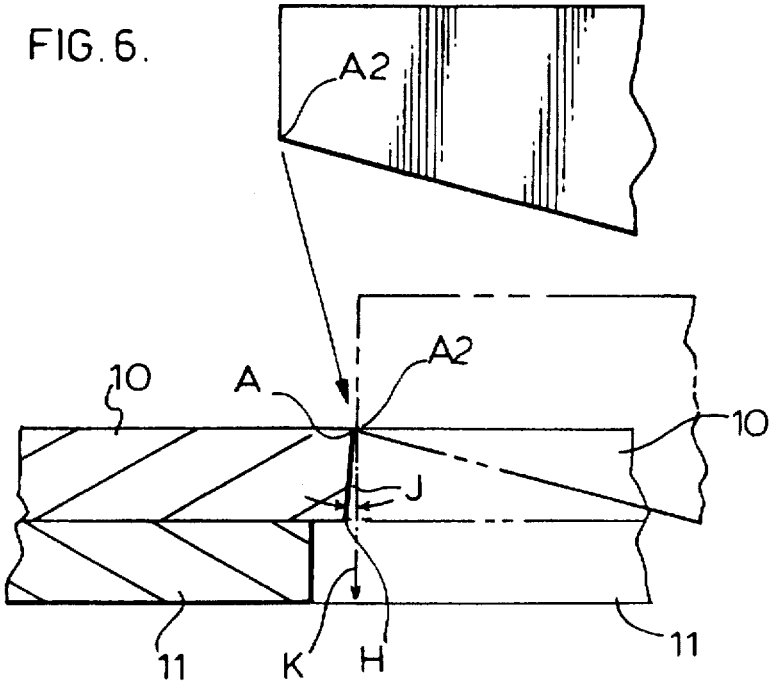
FIG. 6 is a section view showing the lateral retraction of the second pair of edge members during the advance stroke.

As best shown in FIG. 6 the line downed from apex A defining the continuation of the apex groove makes an angle J of about 2° (exaggerated in the drawing) to direction K. It will be noted however from such figures as FIGS. 4 and 8, that contacting edges 12 and 16 or 14 and 18 are not parallel but at a small angle to each other. Thus the contacting edges meet at a very short line known herein as a 'contact point', rather than an extended line and such point contact is considered very important to a clean (cutting every fibre) cutting of the fabric.

The first pair of shear edges 12 and 14 defines a median plane substantially perpendicular to the cutting direction K. (It is noted that edges which are not straight, nor within a single plane, which are within the scope of the invention, may be considered to define a median (i.e. an approximate or average) plane for the purposes of discussion herein).

The second shear edges 16 and 18 may also be considered as defining a median plane.

The second shear edge median plane diverges at angle D at about 20° to the other median plane toward the apex from the line joining points SL1 and SL2, as viewed along that line.

Figure 3:
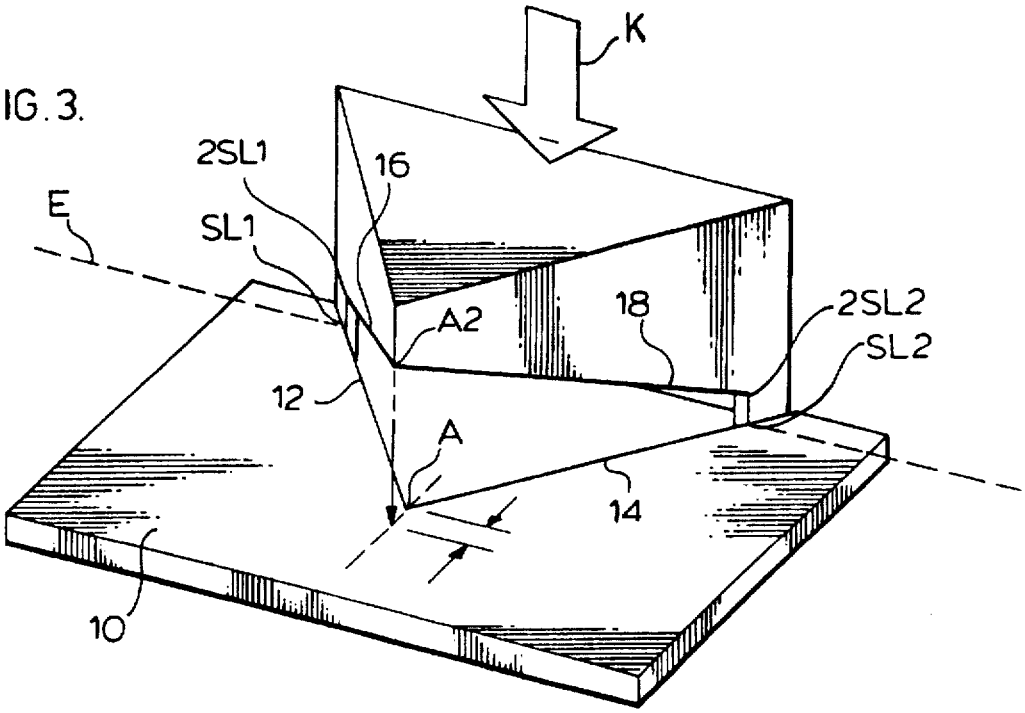
FIG. 3 shows schematically and in perspective the relation of the first and second pairs of edges.
Figure 4:
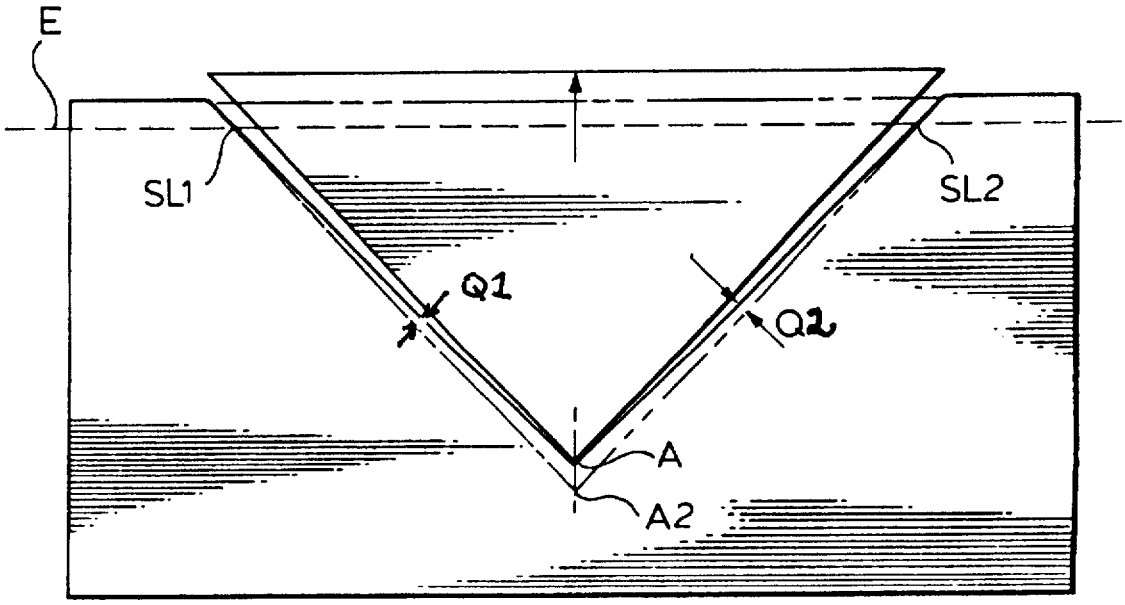
FIG. 4 shows in schematically and in perspective the contact points of the edge members.

The second shear edges are therefore, dimensioned and located on advance movement from retracted position FIG. 3, to a start location, where points 2SL1 and 2SL2 initially contact the first shear edges at SL1 and SL2, respectively. (These points initially coincide with the fabric edge line E and at coincidence define the entrance to the notch and the two pairs of shear edges are arranged so that sets consisting of an edge from each pair will make point contact in the absence of fabric, and on continued advance with fabric in place will sever the fabric at the contact point of the set).

As the advance movement of the second (upper) pair of shear edges 16 and 18 progressively continues the contact points C1, C2 progressively move inwardly along the first shear edges 12 and 14 toward the apex. This progressive movement of the points C1, C2 causes and requires the movement of the second shear edges 16 and 18 in a direction away from the apex A (see FIGS. 6 and 8). This is accommodated by providing that the second shear edges are rigidly mounted on a back member 20 which in turn is resiliently mounted on support member 22. The support member 22, therefore, travels in the cutting direction K usually perpendicular to the median plane of the first shear edges 12 and 14 while the back member 20, with the second shear edges, superimposes on such advance direction the retractive movement which is permitted by the resilient mounting, now to he described. The cutting direction movement, now being described, is continued until the apices A and A2 of the first and second pair of shear edges coincide, (that is until contact points C1 and C2 have reached apex A); at which point the notch has been cut in the fabric edge and the material from the notch may be discarded.

Detailed construction of the second shear edges and their support will now be described. The second "knife" is shaped when viewed in the cutting direction to define a second knife body almost complementary (viewed in such direction) to the first pair of shear edges bat converging at preferably 89° 30' (eighty nine degrees, 30 minutes) rather than 90° (ninety degrees). A second shear edge contacts a first shear edge therefore at a median angle of 15'. The bodies on which the edges 12, 14, 16 and 18 are formed are preferably a hardened tool steel having the discussed shape, in plan, and defining the jaw edges. Walls defined on the intersection of its side and (sloping) lower surface contours define the second shear edges 16 and 18. The contours of edges 16 and 18 are such as to diverge at an approximately 20° (angle D) from the first shear edges when viewed along line SL1–SL2. This slope is from points 2SL1 and 2SL2, spaced to coincide with SL1 and SL2, upwardly toward the apex A2. It will be noted that the slope of 20° is measured viewing in the direction of the line 2SL1–2SL2. The second knife body as shown is rigidly supported on backing member 20 which extends longitudinally approximately parallel to direction K. The backing member is resiliently supported on support 22 and in rest attitude is at a slight downwardly converging angle thereto. The resilient support means for shear edges 16 and 18 comprises upper and lower sets of spring members. In the preferred embodiment the upper set comprises a pair of compression springs 24 each bearing outwardly on the backing member 20 and the support 22 to bias them to a spaced relationship. It is noted that such spacing must be greater than the spacing in plan of the apices A and A2 (in the initial start position of the latter) (see FIG. 4) to allow for retraction of the shear edge members 16 and 18 relative to edges 12 and 14 when apices A and A2 move toward coincidence at the extended position.

The lower set of springs preferably comprises a single spring 25 which is associated with shank 29 mounted on the backing member 20 and slidably extending through aperture 27 in support 22 to a stop 26. The compression spring bears on the stop 26 and the support 22 to bias the backing member 20 toward the support 22. The effect of the opposed biasing at the upper and lower spring sets, in the relaxed position (before the advance stroke) slightly decreases the aforementioned angle below 20° in rest attitude and the angle will vary slightly during movement in the cutting direction.

The mounting for single spring 25 (or mountings for a plurality of such springs, if provided) is designed to allow small lateral as well as longitudinal movement of mounting member 20 relative to support 22. Such mounting or mountings will also allow a small angle of tilt in any axis with a component in the cutting direction. Such flexibility of the mount, includes in the specific embodiment, a loose fit for shank 29 in aperture 27 of mounting member 20 and in support 22.

The mounting for springs 24 near the upper end of the backing member 20 and support 22 also allows for small movement of the backing member 20 longitudinally and laterally and to tilt through a small angle in any azimuth angle about the axis of the spring.

It should also be noted that the opposite biasing of the upper and lower sets of springs tends to provide a quasi pivotal effect at the lower spring 25 since because of the nature of their biasing, many angular changes between backing member 20 and support 22 take place about an approximately horizontal axis near spring 25.

The small angle Q1 between edges 12 and 16 and the small angle Q2 between edges 14 and 18 (when these edges are viewed in the cutting direction (FIGS. 4 and 8), in sum, add to the difference in the convergence angle between upper and lower shear edges. Thus, where the difference in convergence angle is 30' (thirty minutes), as is here recommended, the average or median value of each of Q1 or Q2 is 15' (fifteen minutes). Because of the resilient mounting of one (preferably the upper) set of shear edges, Q1 and Q2 will temporarily vary for short intervals (and in opposite senses) from the mean value during the cutting action. The angles Q1 and Q2 given their temporary variation must be great enough given the strength of spring 24 to make the point contact near enough to the ideal, to cut every fibre in the fabric and small enough to avoid gouging of the edges.

The intersection of edge sets 12 and 16 makes point contact C1 and the intersection of edge sets 14 and 18 makes point contact C2.

It will be noted that the resilient biasing used allows for slight differently compression at the springs of the upper set and for slight lateral movement or tilting of the backing member 20 relative to the support 22. These allowed activities permit a self centering action during the advance stroke since, in the event of a slight misalignment for any reason, one contact point (say C1) advances closer to the apex A and C2, the forces at C1 and C2 on the second pair of shear edges 16 and 18 tend to move the second pair of edges so that C2 equalizes with C1.

Figure 8:
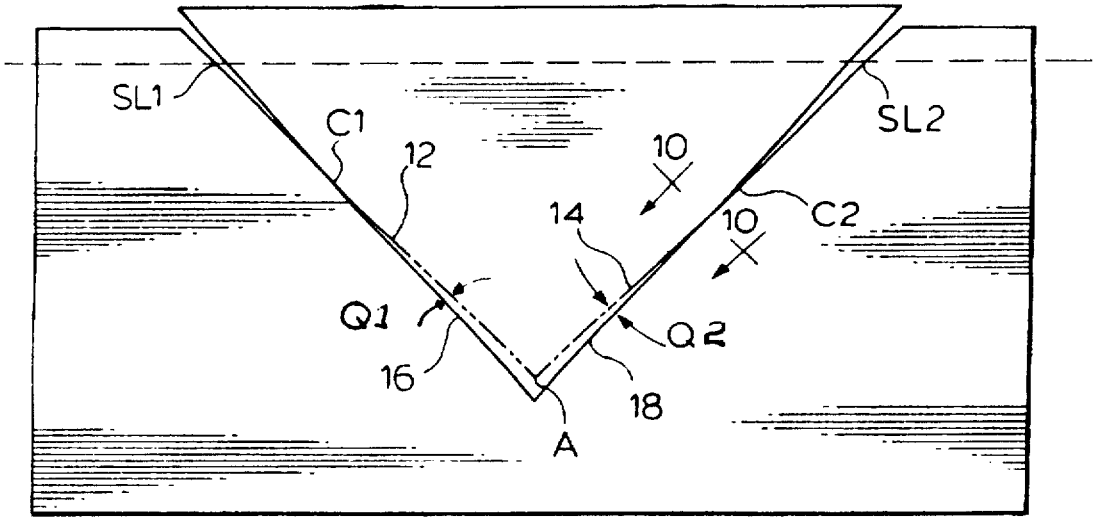
FIG. 8 shows in plan the relationship of the two knife members at an intermediate stage of the stroke.
Figure 9:
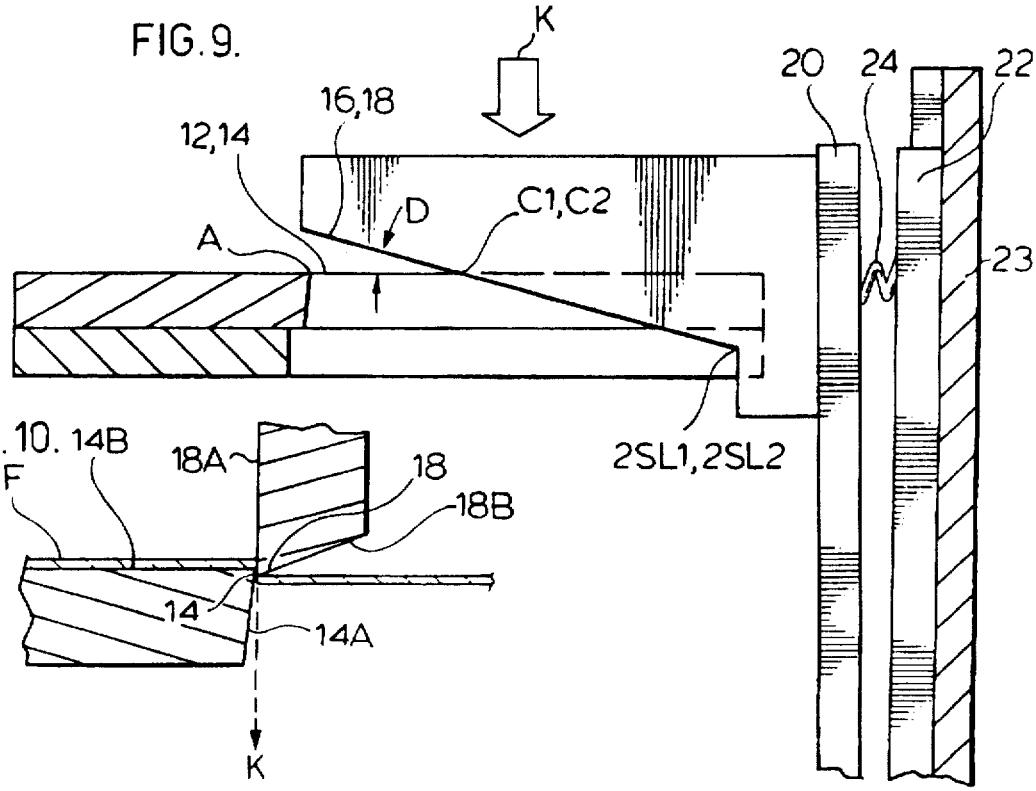
FIG. 9 shows a side view of the two knife members at an intermediate stage of the stroke.
Figure 10:
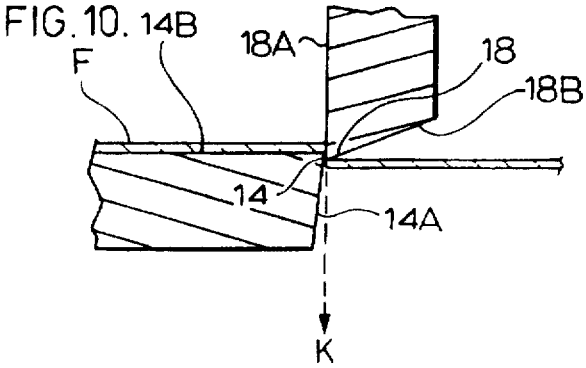
FIG. 10 is a view along the lines 10—10 of FIG. 8.

Support 22 is adapted to reciprocate between the rest and advanced position in the cutting and opposite direction. (Rest position is that shown in FIG. 3). Retract position is the point when the advance movement has brought points 2SL1 and 2SL2, respectively into contact with points SL1 and SL2. Advance position is where A contacts A2 and the contact points C1, C2 have, with the advance stroke, progressively moved from SL1 to A and SL2 to A, respectively. FIG. 8 is a view of the points C1, C2 respectively intermediate points SL1 and A, and SL2 and A. FIG. 9 is a side view showing the point C1 at 2 locations intermediate SL1 and A.

Figure 5:
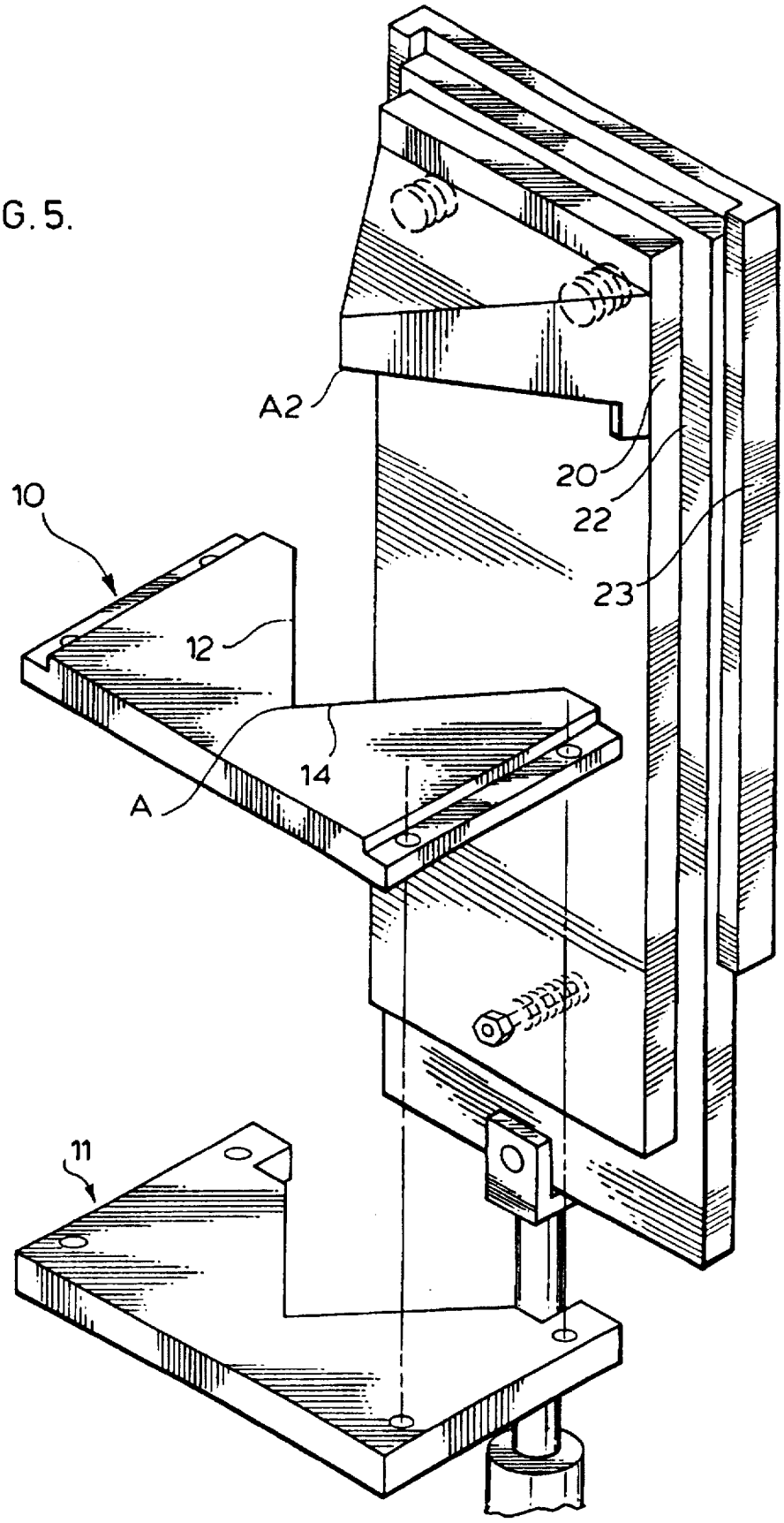
FIG. 5 is an exploded perspective view to the knife members and their supports.
Figure 7:
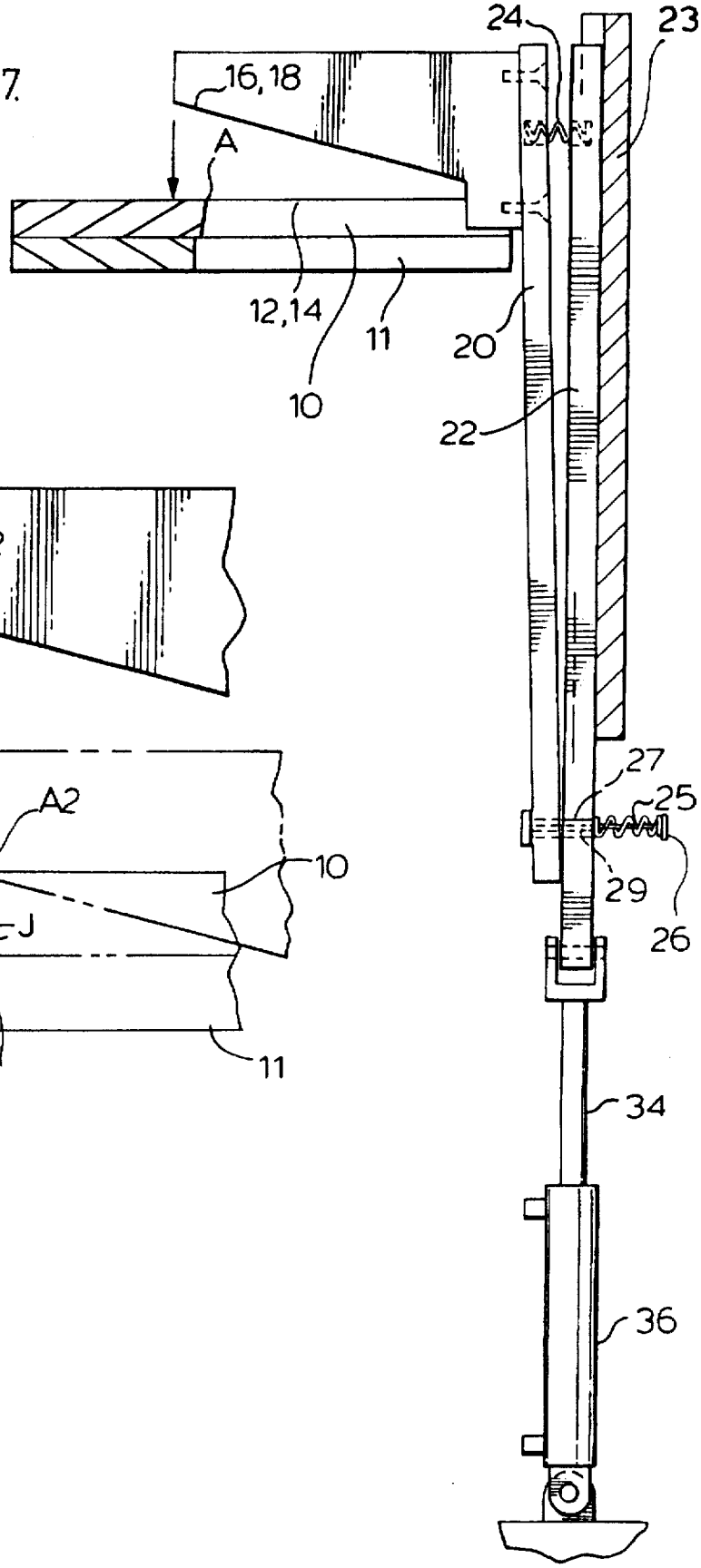
FIG. 7 is a vertical section of the edge members.

Support 22 is driven and guided to move in direction K in any desired manner. For example, FIG. 5 shows support member 22 moving in the (schematic) guideways of guide member 23 to move in direction K. The drive to move support 22 between retracted and extended position may be provided by piston rod 34 activated by piston 36. The outside mountings on a suitable base for guide member 23 and for piston 36 are not shown.

It is believed that the operation of the device will be obvious from the foregoing description but it will be synopsized here. Initially the fabric is in place, with the fabric edge E lying along the line SL1–SL2, and the rest position of the upper and lower knife members is as shown in FIG. 3. The shear edges 16 and 18 of the second knife are above and, looking in direction K just outward of the points SL1 and SL2.

The second knife is advanced toward the first in direction K so that point 2SL1 contacts point SL1, temporarily defining moving contact point C1 and 2SL2 contacts point SL2 temporarily defining moving contact point C2.

As movement of the second knife in the advance direction progressively continues, contact points C1, C2 move along edges 12, 14 toward apex A. FIGS. 8 and 9 show C1, C2 at an intermediate position between SL1, S12, respectively and A. During such progressive movement the reaction of edges 12, 14 on, respectively edges 16, 18 retracts edges 16, 18 and backing member 20 against the bias of spring 24.

Meanwhile the fabric has been progressively cut inward from the edge at the points C1, C2.

As the advance stroke is completed the points C1, C2 have moved to coincidence at point A and the cut is complete. The path of A2 toward A during the advance stroke is shown in FIG. 6.

After completion of the advance stroke, in accord with conventional means, but not shown, the notch material is removed, the second knife is moved to the retracted position, and the fabric is moved away from the supply roller (or cut and then so moved) so that a new swatch of fabric is positioned to be cut in the cycle.

It is noted that with the folded fabric of FIGS. 2 and 3 (with the fold line defining the edge E) a square of fabric is removed to provide an aperture of the shape of the notch plus its mirror image.

Discussions of parameters follow.

The average or median value of each of angles Q1, Q2 measured looking in cutting direction K between each set of interacting shear edges is preferably between 0° 5' and 0° 30' and 0° 15' is thought best. It is difficult to set upper and lower limits for such angles. The angle will vary for the type of fabric being cut, the material of the shear edges and the amount of variation in the geometry of the knives. However, too small an angle risks converting the point contact between the edges into a line contact which may cause incomplete fibre cutting or jamming of the knives. It must also be noted that this effect may occur at one only pair of interacting shear edges since the resilient mounting allows slight skewing of the second shear edges under some reactive stresses. The upper limit for the differential angle (looking in direction K) between interacting shear edges is controlled, inter alia, by the fact that, with increase of differential angle the retraction stroke permitted by the resilient mounting must be increased and this is both inconvenient and will allow too much leeway for twisting and torsion of the second knife. Moreover a large differential angle tends to cause chipping of interacting edges and it must be remembered that the differential angle may increase at one set of interacting edges and decrease at the other because of the skewing permitted at the differential mounting.

It is further difficult to set limits for the differential angle D between the upper and lower edges as measured in a view along line SL1–SL2 (FIG. 9). If this angle is too great the vertical stroke required of the equipment is too large for convenience and further the chance of chipping at the edges is increased. If the angle is too small the risk of changing point contact into line contact is increased, and it is noted that this possibility is increased by the tilting allowed by the resilient mount.

Where it is desired to sever, and treat the ends of a strip whose width is narrower than the distance from notch mouth (or entrance) to apex, the full edge pairs, as already described, may still be used.

However, where the knife edge pairs are dedicated to cutting narrower strip, the pairs may each be truncated short of their apices.

Figure 11:
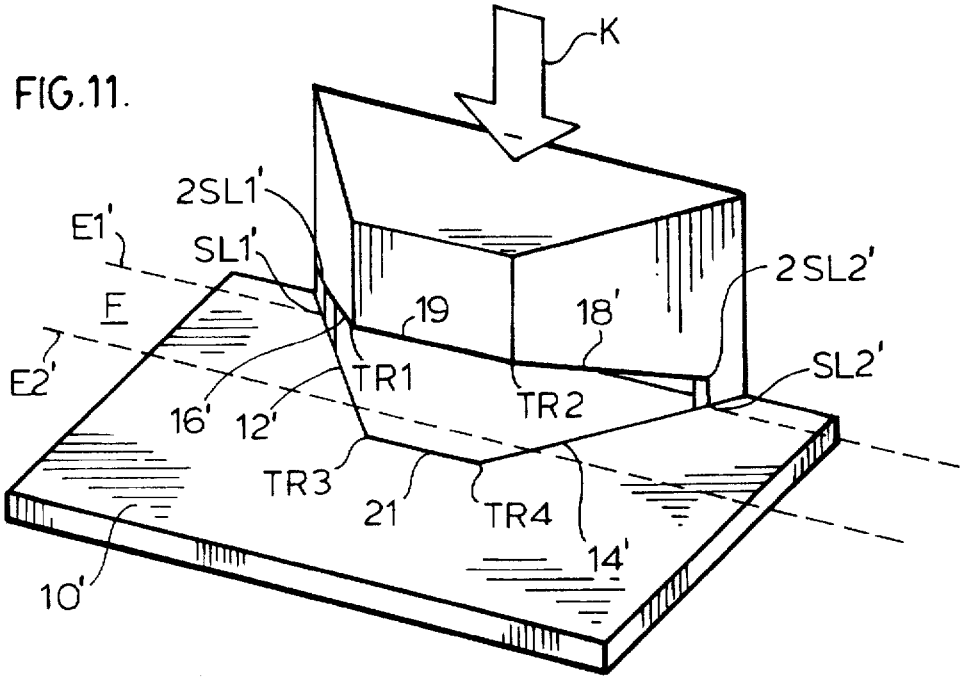
FIG. 11 (analogous to FIG. 3) shows first and second pairs of shear edges truncated short of respective apices for cutting narrower strip.

Thus, in FIG. 11, apparatus with a truncated version of the shear edges is shown. Elements similar to those of previous drawings are designated by the previous element number with a prime "'" added.

Figure 12:
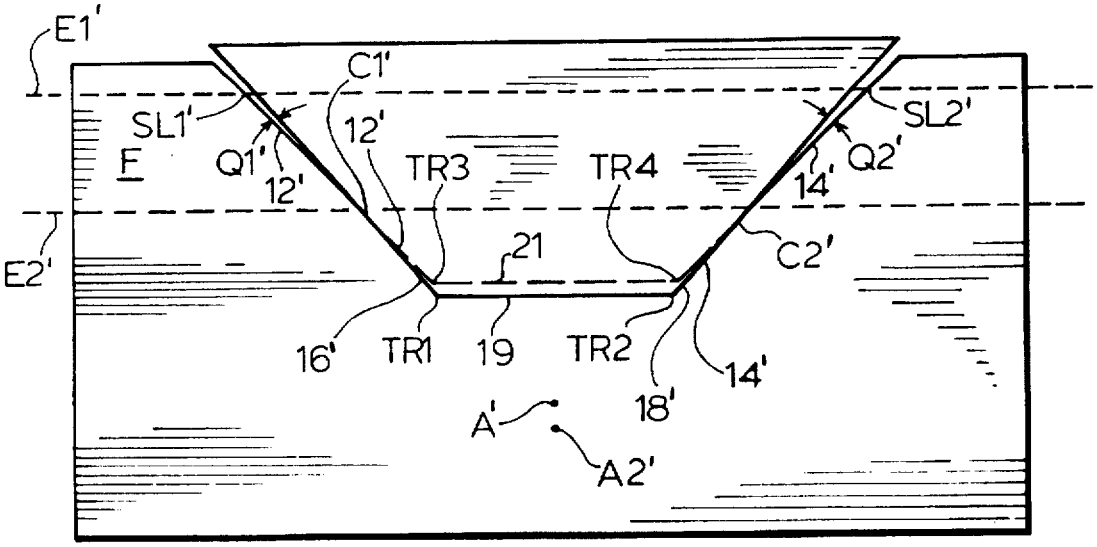
FIG. 12 (analogous to FIG. 8) shows the two knife members of FIG. 11 at an intermediate stage of the stroke.

Thus in FIGS. 11 and 12, the upper pair of shear edges 16', 18' end at TR1, TR2 respectively and the lower pair of shear edges 12', 14' end at TR3 and TR4. Although the apices are not physically present, the respective converging edges define their hypothetical position which is shown at A2' and A' on FIG. 12.

Thus, converging edges 16' and 18' end at edge 19 and converging edges 12' and 14' end at edge 21.

In operation a strip F' with its width from edge E1' to edge E2', less than the distance from line SL1'–SL2' to line 21, is placed with its edge E1 extending between start positions SL1' and SL2'.

Both inwardly and outwardly facing shear edge pairs, their mounting, including resilient mountings)are the same as previously described as are the convergence angles to the (hypothetical) apices A and A2. Thus the differential angles between the contacting shear edges Q1' and Q2' are respectively equal to Q1 and Q2.

The stroke in direction K which advances edges 16' and 18' into respective shearing contact with edges 12' and 14', is carried on as before, but in this case the stroke is terminated when the strip F' is severed.

After such stroke is completed, the strip may be moved lengthwise along to perform the severance and end shaping operation at the next location.

Figure 13:
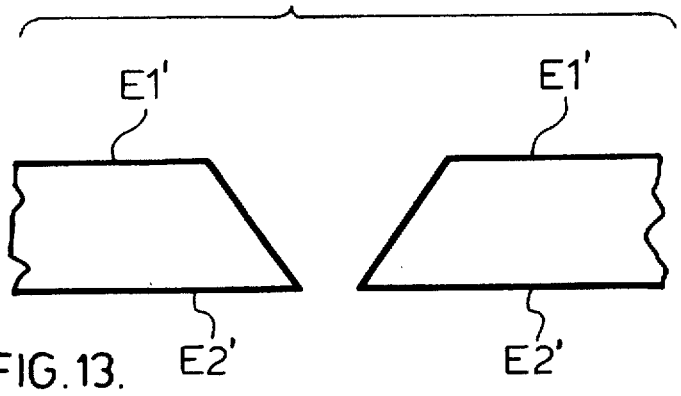
FIG. 13 shows schematically a narrower strip severed by the shear edges of FIG. 11.
Figure 14:
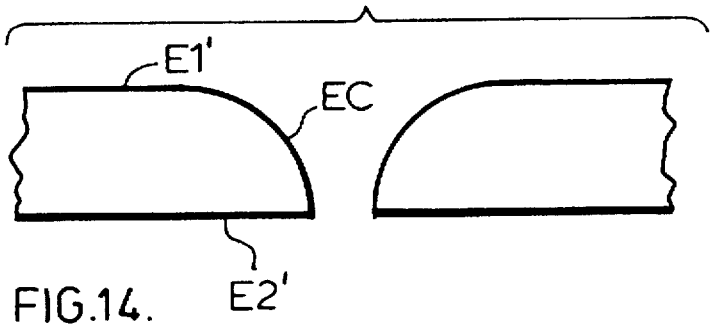
FIG. 14 shows schematically a narrower strip severed by shear edges of curved contour.

FIG. 13 shows a notched strip which is the result of such an operation with the shear edges of FIGS. 1–10 or of 11 and 12. FIG. 14 shows a notched strip which is the results of such a severance and shaping operation where the shear edges are curved. In FIG. 13 the ends between edges E1' and E2' have been shaped. Each end will extend to a mirror-image end not shown. In FIG. 14 the ends between E1' and E2' are shaped to form a curve EC.

I claim:

1. Fabric notch cutter for cutting a notch defining an entrance width in said notch, comprising;

a pair of inwardly facing shear edges defining a first median plane and converging in a first direction from two first points spaced at a predetermined distance from each other to a first apex, whereby said entrance width is substantially equal to said predetermined distance, a pair of outwardly facing shear edges defining a second median plane, and converging from two second points, which are spaced substantially at said predetermined distance from each other, a projection of said outwardly facing shear edges on said first median plane converging at a substantially slightly lesser angle than the inwardly facing shear edges, means for moving at least one of said pairs of shear edges relative to the other in a cutting direction generally transverse to said first direction, said inwardly facing shear edges and said outwardly facing shear edges being mounted, located and oriented with respect to one another such that relative movement of said outwardly facing shear edges in said cutting direction first moves said pair of outwardly facing shear edges and said pair of inwardly facing shear edges into contact with one another so that each of said outwardly facing shear edges contacts a respective one of said inwardly facing shear edges to provide contact points initially spaced at said predetermined width, and then causes said contact points to move toward said apices until said apices coincide, and first support means for supporting said pair of outwardly facing shear edges for movement in a second direction generally opposite said first direction, and for resiliently biasing said pair of outwardly facing shear edges to yieldably oppose said movement in said second direction.

2. Fabric notch cutter as claimed in claim 1 wherein said first support means further resiliently supports said pair of outwardly facing shear edges for relative tilting in a direction generally transverse to said first and second directions.

3. Cutter comprising;

a pair of inwardly facing shear edges defining a first median plane and continuously converging in a first direction from a first entrance, a pair of outwardly facing shear edges defining a second median plane and continuously converging from a second entrance, a projection of said outwardly facing shear edges on said first median plane converging at a substantially slightly lesser angle than said inwardly facing shear edges, said outwardly facing shear edges assuming a start location relative to said inwardly facing shear edges wherein said first and second entrances are coincident, and wherein, in said start location said second median plane slopes away from said first median plane in said first direction, means for bringing each of said outwardly facing shear edges in a cutting direction generally transverse to said first median plane into contact with a respective one of said inwardly facing shear edges at a respective contact point and for moving said pair of outwardly facing shear edges relative to said pair of inwardly facing shear edges in said cutting direction to cause said contact points to continuously progress along said shear edges to an advanced position, and means for supporting one of said pairs of shear edges for movement in a second direction which is generally parallel to said first direction, wherein said one pair of shear edges is biased against said movement in said second direction.

4. Cutter as claimed in claim 3 wherein said means for supporting further supports movement of said one of the pair of shear edges laterally relative to said first direction, against a resilient bias.

5. Cutter comprising:

a pair of inwardly facing shear edges defining a first median plane and continuously converging in a first direction from a first entrance, a pair of outwardly facing shear edges defining a second median plane and converging from a second entrance, a projection of said outwardly facing shear edges on said first median plane converging at a substantially slightly lesser angle than said inwardly facing shear edges, said second median plane being angularly oriented with respect to said first median plane, means for moving at least one of said pairs of shear edges relative to the other in a cutting direction generally transverse to said first median plane, and support means for supporting one of said pairs of shear edges for movement in a direction generally transverse to said cutting direction, said one pair of shear edges being resiliently biased against the transverse movement, whereby each of said outwardly facing shear edges contacts a respective one of said inwardly facing shear edges when said entrances are in coincidence and the contact points progress in said first direction during said movement in said cutting direction, and whereby said movement in said cutting direction causes movement of said one pair of shear edges relative to the other in said direction transverse to the cutting direction.

6. Cutter as claimed in claim 5 wherein said support means includes a resilient mounting for said one pair of shear edges which supports slight relative movement of said one pair of shear edges relative to the other pair of shear edges in a direction generally transverse to said cutting direction and generally transverse to said first direction.

7. Fabric cutter comprising:

a pair of inwardly facing shear edges defining a first median plane and continuously converging in a first direction to define a first entrance and a first apex, a pair of outwardly facing shear edges defining a second median plane and converging to a second apex, a projection of said outwardly facing shear edges in said first median plane converging at a substantially slightly lesser angle than said inwardly facing shear edges, said second median plane sloping away from said first median plane in said first direction, means for moving at least one of said pairs of shear edges relative to the other in a cutting direction, wherein said cutting direction is generally transverse to said first median plane, thereby bringing each of said outwardly facing shear edges and a respective one of said inwardly facing shear edges into contact with one another at a respective contact point and continuing the movement of said one pair of shear edges relative to the other in said cutting direction, and means for supporting one of said pairs of shear edges for movement in a direction generally parallel to said first direction, whereby said contact points continuously progress toward said apices during said movement in said cutting direction until said first and second apices contact each other.

8. Fabric cutter as claimed in claim 7 wherein said means for supporting resiliently supports said one pair of shear edges for movement in either lateral direction relative to the other pair wherein said lateral direction is generally transverse to said first direction.

9. Notch cutter comprising:

a pair of inwardly facing shear edges defining a first median plane and continuously converging in a first direction to define a first entrance and a first apex, a pair of outwardly facing shear edges defining a second median plane and converging to a second apex, a projection of said outwardly facing shear edges on said first median plane converging at a substantially slightly lesser angle than said inwardly facing shear edges, said second median plane being angularly oriented with respect to said first median plane, means for moving at least one of said pairs of shear edges relative to the other in a cutting direction generally transverse to said first median plane, and support means for supporting one of said pairs of shear edges for movement in a direction generally transverse to said cutting direction, said one pair of shear edges further being resiliently supported against the transverse movement, whereby each of said outwardly facing shear edges contacts a respective one of said inwardly facing shear edges at a contact point and the contact points progress toward said apices during said movement in said cutting direction.

and whereby said movement in said cutting direction causes movement of said one pair of shear edges relative to the other in said direction transverse to the cutting direction.

10. Notch cutter as claimed in claim 9 wherein said support means supports said one pair of shear edges for slight relative movement of said one pair of shear edges relative to said other pair of shear edges in a direction generally transverse to said cutting direction and generally transverse to said first direction.

11. Notch cutter as claimed in claim 10 wherein said slight relative movement is a slight tilting of said one pair of shear edges relative to the other said pair of shear edges, and said support means supports said one pair of shear edges for said slight tilting against a resilient bias.

* * * * *